US006438845B1

(12) United States Patent
Jung

(10) Patent No.: US 6,438,845 B1
(45) Date of Patent: Aug. 27, 2002

(54) NAIL CLIPPER DEVICE

(76) Inventor: Koock E. Jung, 597 Bay Rd., Queensbury, NY (US) 12804

( * ) Notice: Subject to any disclaimer, the term of this patent is extended or adjusted under 35 U.S.C. 154(b) by 0 days.

(21) Appl. No.: 09/761,438

(22) Filed: Jan. 16, 2001

(51) Int. Cl.[7] ..... A45D 29/00
(52) U.S. Cl. ..... 30/29; 30/28
(58) Field of Search ..... 30/28, 29; 132/75.5

(56) References Cited

U.S. PATENT DOCUMENTS

| | | | | | |
|---|---|---|---|---|---|
| 138,061 | A | * | 4/1873 | Whittemore | 30/29 |
| 4,644,644 | A | * | 2/1987 | Elsholz | 30/28 |
| 5,226,849 | A | | 7/1993 | Johnson | |
| 5,357,676 | A | | 10/1994 | Bannett | |
| 5,357,677 | A | | 10/1994 | West | |
| 5,488,772 | A | | 2/1996 | Dababneh | |
| 5,570,509 | A | | 11/1996 | Killian | |
| 5,640,770 | A | | 6/1997 | Fowler | |
| 5,870,826 | A | | 2/1999 | Lewan | |
| 5,881,461 | A | | 3/1999 | Schwartz | |

* cited by examiner

*Primary Examiner*—Douglas D. Watts

(57) ABSTRACT

A nail clipper device with a scissors-like cutting configuration comprises elongated upper and lower operating members each having first ends joined together, and second ends terminating in spaced complimentary shaped cutting edges; a post secured to the lower operating member and movably extending through an aperture in the upper member adjacent the cutting edges; a lever member having first and second ends with the first end begin pivotally secured to the post, the upper operating member having an exterior surface with the lever member being superimposed over the upper operating member in a non-operable position; the lever member having a bent portion adjacent the post so the lever member is first pivoted about the axis of the post, and pivoted in over the post to an operating position, the bent portion of the lever will bear against the upper operating member to move the cutting edge. Each cutting edge of the nail clipper device comprises slanted cutting surfaces and complementary cutting adjacent and juxtaposed surfaces that are moved adjacent to each other and in juxtaposed position with each other when the cutting configuration is brought into cutting relationship. The cutting edges define a space and separation distance therebetween with a first separation distance at one side and a second separation at the opposite side. The first separation distance is greater than the second separation distance.

3 Claims, 2 Drawing Sheets

NAIL CLIPPER DEVICE

BACKGROUND OF THE INVENTION

The invention relates to a nail clipper device. In particular, the invention relates to a nail clipper device nail clipper device for enhancing clipping of nails.

Conventional nail clipper devices are well known in the prior art and used by many people throughout the world. These nail clipper devices typically comprise a lever-like mechanism that applies a cutting force equally across the nail, which is intended to be clipped. Most typically nail clipper devices further comprise cutting units with sharpened edges. These sharpened edges are moved by the lever action of the conventional nail clipper device and abut each other in direct contact with each other. The sharpened edges do not overlap with each other and merely touch at the sharpened edges. Accordingly, these conventional nail clipper devices require increased amounts of force to start the clipping action due to the entire length of the sharpened cutting edges needing to simultaneously cut the entire finger nail.

By virtue of this abutting and direct contact, any finger nail being cut by these sharpened edges of the conventional nail clipper device are quickly severed from the remaining finger nail. The part of the finger nail that is being cut is often cut from the remaining nail with such a force that the cut nail is propelled away from the remaining finger nail. The cut finger nail, which is propelled away from the remaining finger nail in unpredictable directions, is not able to be retained and is typically displaced far from the finger. Thus, the cut finger nail is not retained and often lost, which is undesirable and unsanitary.

Further, conventional nail clipper devices are not well suited for cutting finger and toe nails (hereinafter collectively or in the singular referred to as "nails") that are thickened, for example nails that are firm and inflexible. These thickened nails can be thickened by a condition often referred to as hypertrophy. Conventional nail clipper devices with the simple abutting sharpened edge cutting configuration do not easily permit clipping and cutting of these thickened and inflexible nails.

Thus, a need exists for providing a nail clipper device that does not lose cut finger nails. Further, a need exists for a nail clipper device that acts to cut the nail to retain the cut nail, in which the nail clipper device provides an alternative to the conventional cutting units with sharpened edges that abut each other. Furthermore, a need exists for a nail clipper device that can easily cut thick and inflexible nails.

SUMMARY OF THE INVENTION

A nail clipper device with a scissors-like cutting configuration. The nail clipper device comprises: elongated upper and lower operating members each having first ends joined together, and second ends terminating in spaced complimentary shaped cutting edges; a post secured to said lower operating member and movably extending through an aperture in said upper member adjacent said cutting edges; a lever member having first and second ends with said first end begin pivotally secured to said post, said upper operating member having an exterior surface with said lever member being superimposed over said exterior surface of said upper operating member in a non-operable position; said lever member having a bent portion adjacent said post so that when said lever member is first pivoted about the axis of said post, and then pivoted in over said post, to an operating position, said bent portion of said lever will bear against said upper operating member to move the cutting edge of said upper operating member into cutting relationship with said lower operating member; wherein said lower operating member having a lower exterior surface, said lever member having an upper operating surface when in its operating position; each cutting edge of the nail clipper device comprises slanted cutting surfaces and complementary cutting adjacent and juxtaposed surfaces that are moved adjacent to each other and in juxtaposed position with each other when the cutting configuration is brought into cutting relationship; the cutting edges defining a space therebewteen when in an open non-cutting configuration, the space defining a separation distance therebetween, the separation distance comprising a first separation distance at one side of the cutting edges and a second separation at the opposite side of the cutting edges, wherein the first separation distance is greater than the second separation distance.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

A nail clipper device 10, as embodied by the invention, is illustrated in FIGS. 1–4. The nail clipper device 10 is comprised generally of a base lever element 12, an intermediate lever element 14, and an operating lever element 16. Lever element 12 has ends 12*a* and 12*b*, and upper surface 12*c* and a lower surface 12*d*. Lever element 14 comprises ends 14*a* and 14*b*, and upper surface 14*c*, and a lower surface 14*d*. Lever element 16 comprises opposite ends 16*a* and 16*b*, an upper surface 16*c*, and a lower surface 16*b*.

Figure 2:
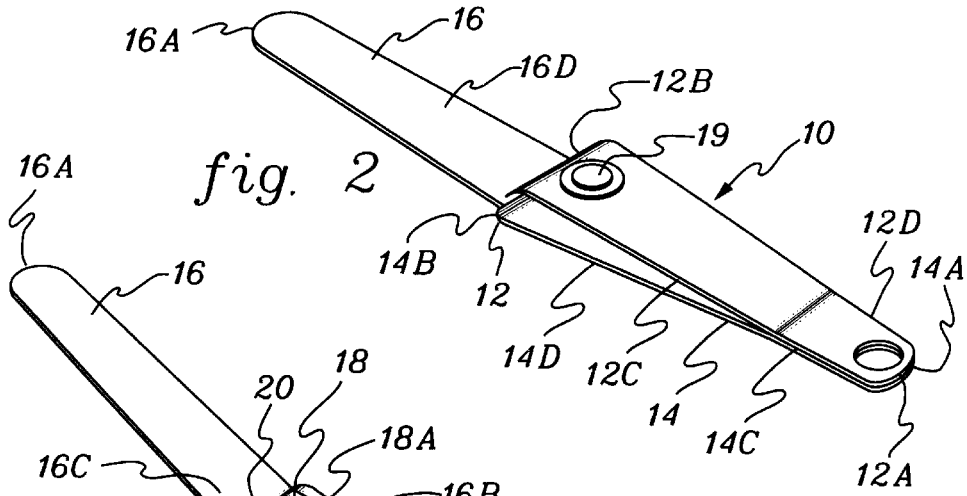
FIG. 2 is an illustration similar to that of FIG. 1, wherein the nail clipper device, as embodied by the invention, of FIG. 1 has been rotated about its longitudinal axis 180 degree.
Figure 1:
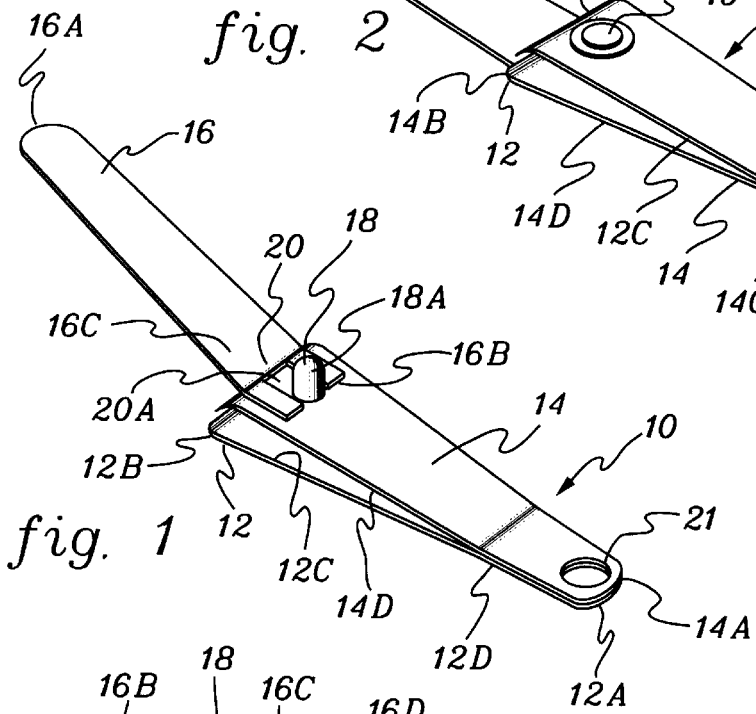
FIG. 1 is a perspective illustration of a nail clipper device, as embodied by the invention, with the operating lever element in an extended position intermediate its storage position and its operating position.
Figure 3:
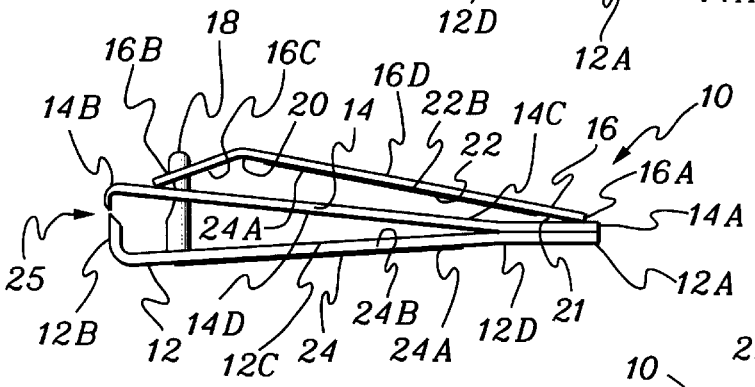
FIG. 3 is a side elevation illustration of the nail clipper device, as embodied by the invention, of FIG. 1 in its storage position.
Figure 4:
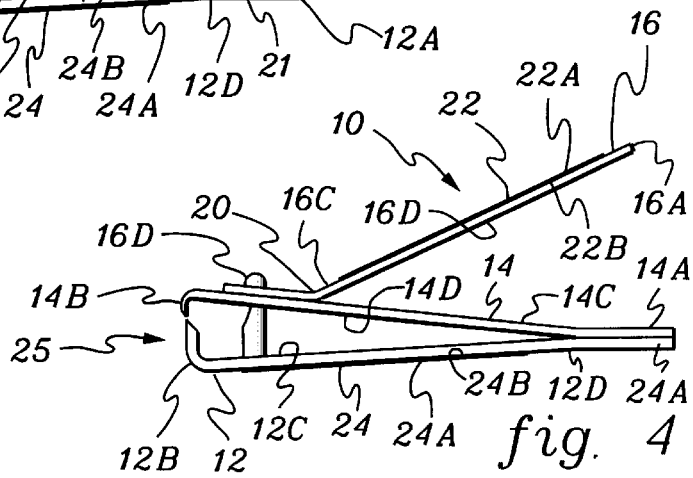
FIG. 4 is a side elevation illustration similar to that of FIG. 3 but shows the nail clipper device, as embodied by the invention, in its operating position.

The nail clipper device 10 further comprises a post 18 that is rotatably secured by its lower end to the upper surface 12*c* adjacent end 12*b* by means of bearing 19 (FIG. 2). The post 18 extends upwardly through an aperture (not shown) in lever 16 as illustrated in FIGS. 1, 3 and 4. Ends 12*b* and 14*b* constitute the cutting edges of clipper tool 10 that will be described in further detail hereinafter.

The end 16*b* of lever 16 is pivotally secured to the upper end of post 18 by means of a horizontal pin 18*a* which is shown by the dotted lines in FIG. 1. A bent portion 20 is provided in the lever 16 as best illustrated in FIGS. 3 and 4. The bent portion 20 exists adjacent a center recess 20*a* in the end of lever 16 (FIG. 1). The lever 16 can be rotated about a vertical axis, for example, the vertical axis of post 18, and this also causes the post 18 to rotate about its vertical axis by means of the bearing 19. The lever 16 can also be rotated about the horizontal axis of pin 18*a* as it is moved from the position in FIG. 3 to the positions of FIG. 1 and/or FIG. 4. The ends 12*a* and 14*a* of the lever elements 12 and 14 can be secured together by a rivet or the like 21.

The nail clipper device 10 further comprises a cutting configuration 25 at the ends 12B and 14B respectively. The cutting configuration 25 is illustrated generally in FIGS. 1–4 and in detail in FIGS. 5+. The cutting configuration 25 comprises a cutting edge 26 on the end 14B and a complementary cutting edge 27 on the end 12B. The cutting edges 26 and 27 cooperate with each other, as explained hereinafter, to cut a portion of a finger nail with a scissors-like action to cut the finger nail form one nail edge to the other. Thus, as discussed herein, the cut nail is not propelled away from the remainder of the fingernail, so that the cut nail is not lost.

Further, the scissors-like action of the nail clipper device 10 also permits a user of the nail clipper device 10 to cut finger nails that are thicker that normally encountered. The scissors-like action of the nail clipper device 10 starts cutting at one side of the finger nail and the cut continues across the finger nail to progressively cut across the nail. Accordingly, the nail clipper device 10, as embodied by the invention, can employ the scissors-like action to provide enhanced cutting of thick finger nails.

Figure 5:
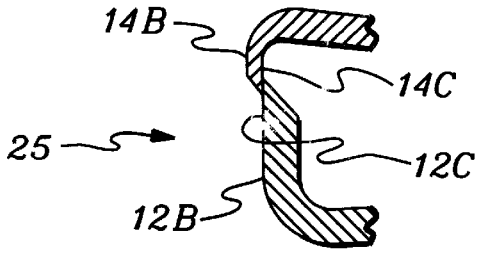
FIG. 5 is a schematic illustration of the cutting configuration of the nail clipper device, as embodied by the invention.

The cutting configuration 25 of the nail clipper device 10, as embodied by the invention, is illustrated in FIGS. 5+, with only the cutting configuration 25 illustrated for ease of illustration. In these figures, each of the ends 12B and 14B comprise slanted cutting surfaces 30 and 31, respectively. Further each of the ends 12B and 14B also comprise complementary cutting adjacent and juxtaposed surfaces 12C and 14C.

The complementary cutting adjacent and juxtaposed surfaces 12C and 14C are positioned so that they are moved during the operation of the nail clipper device 10 glide next to each other, in a similar manner as conventional scissors. Thus, the adjacent and juxtaposed surfaces 12C and 14C may contact each other in sliding fashion, however, the complementary cutting adjacent and juxtaposed surfaces 12C and 14C do not interfere with the reciprocation of the ends 12B and 14B during operation of the nail clipper device 10.

Figure 6:
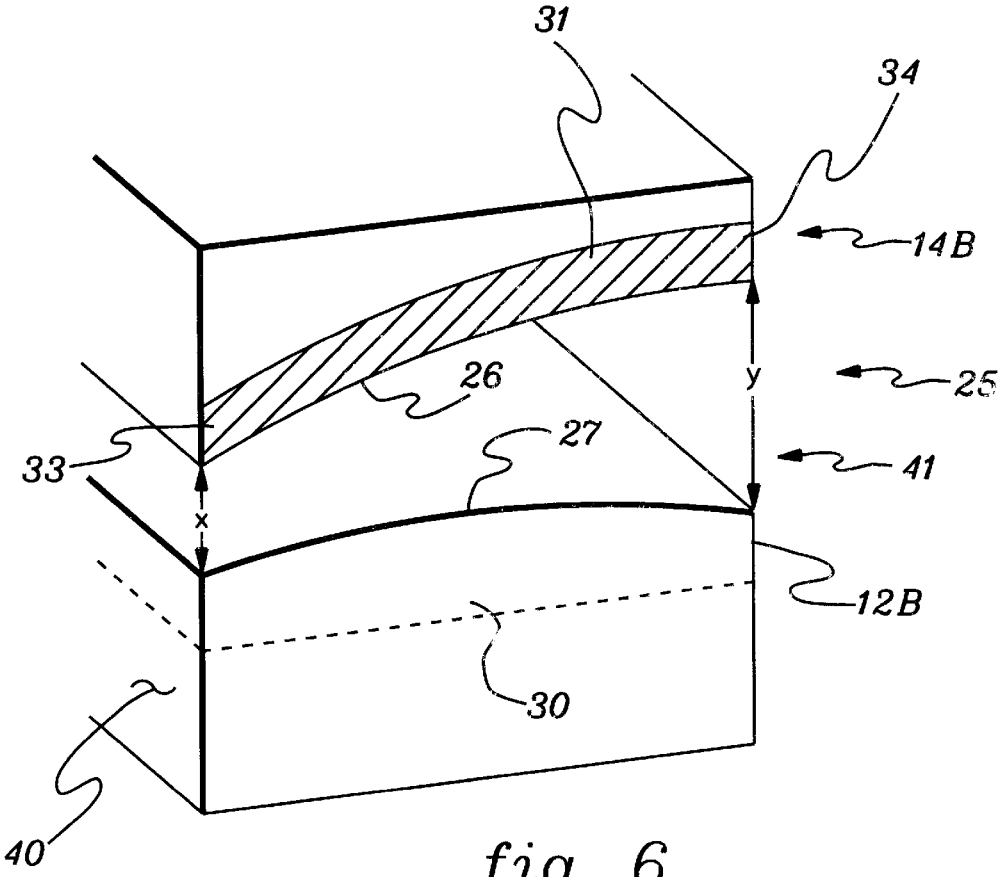
FIG. 6 is a further schematic illustration of the cutting configuration of the nail clipper device, as embodied by the invention.

The ends 12B and 14B each also comprise slanted surfaces 30 and 31. These slanted surfaces 30 and 31 and the adjacent and juxtaposed surfaces 12C and 14C define cutting edges 27 and 26, respectively. As illustrated in FIG. 6, the cutting edges 27 and 26 are provided on the ends 12B and 14B in a configuration so that in an un-actuated position (FIG. 6) the distance X separating the cutting edges 27 and 26 is greater at one side 41 of the nail clipper device 10 than the distance Y at the opposite side 40 of the nail clipper device 10. For example, and in no way limiting if the invention, the separation distance can reduce linearly across the cutting edges. Alternatively, the separation distance can reduce in an arcuate curved fashion across the cutting edges. These separation distance configurations, as embodied by the invention, are merely exemplary, and are not intended to limit the invention in any manner, and other configurations are within the scope of the invention.

The representations of the distances X and Y and the sides 40 and 41 illustrated FIG. 6 are merely exemplary. These representations are not intended to limit the invention in any manner. Other configurations of the distances X and Y and the sides 40 and 41 are within the scope of the invention as long as the scissors-like operation of the nail clipper device 10 is maintained.

The operation of the nail clipper device 10, as embodied by the invention, will now be described with specific reference to the benefits of the cutting configuration 25 of the nail clipper device 10. A user of the nail clipper device 10 will grasp the nail clipper device 10 between fingers and/or a thumb. The user applies pressure to the lever 16 and the base lever element 12, therefore moving the cutting configuration 25 and edges 12B and 14B toward each other while a finger nail is positioned therebetween. The operation that causes the movement of the cutting configuration 25 and edges 12B and 14B are well known in the art and a further discussion will be omitted.

The edges 12B and 14B of the cutting configuration 25 are thus moved toward each other. The movement of the edges 12B and 14B of the cutting configuration 25 will cause the cutting edges 26 a and 27 toward each other. The side 40 of the cutting edge 26 that has the smaller separation distance X will come into cutting engagement with the finger nail first, in a similar manner as the part of a scissors closest to the pivot will cut before the remote (pointed) end of a scissors will come into cutting engagement. With further movement of the cutting edges 26 and 27 of the cutting configuration 25 toward each other by operation of the nail clipper device 10, the and 27. The movement, in a scissors-like operation will continue across the cutting configuration 25 until the edges 12B and 14B at the side 41 are in overlapping arrangement and cooperation.

The above-described operation of the nail clipper device 10 and the cutting configuration 25 will enable the nail clipper device 10, as embodied by the invention, to cut most finger and toe nails. For example, and in no way limiting of the invention, enlarged and thickened finger nails can be easily cut by the nail clipper device 10 as the scissors-like cutting configuration 25 will provide a smooth and even cutting.

Further, the nail clipper device 10, as embodied by the invention, will control and prevent uncontrolled displacement of the cut finger nail. The scissors-like cutting operation will control the cut nail so it is not propelled away from the remaining finger nail. The scissors-like cutting operation will slowly cut across the finger nail and retain most of the nail cut finger nail close to the nail clipper device 10, so the cut nail is not propelled away from the remaining finger nail in unpredictable directions, is able to be retained, and is typically located close to the finger.

The materials of the nail clipper device 10 may be any conventional material, such as but not limited to metals, composites, and the like. These materials are not intended to limit the invention in any manner, and further materials are within the scope of the invention.

While embodiments of the invention have been described, the present invention is capable of variation and modification, and therefore should not be limited to the description herein. The invention includes changes and alterations that fall within the purview of the following claims. Individual components of the described and illustrated embodiments may be used interchangeably with each other components of the described and illustrated embodiments.

What is claimed:

1. A nail clipper device with a scissors-like cutting configuration, the nail clipper device comprising:

elongated upper and lower operating members each having first ends joined together, and second ends terminating in spaced complimentary shaped cutting edges, a post secured to said lower operating member and movably extending through an aperture in said upper member adjacent said cutting edges, a lever member having first and second ends with said first end begin pivotally secured to said post, said upper operating member having an exterior surface with said lever member being superimposed over said exterior surface of said upper operating member in a non-operable position, said lever member having a bent portion adjacent said post so that when said lever member is first pivoted about the axis of said post, and then pivoted in over said post, to an operating position, said bent portion of said lever will bear against said upper operating member to move the cutting edge of said upper operating member into cutting relationship with said lower operating member, wherein said lower operating member having a lower exterior surface, said lever member having an upper operating surface when in its operating position, each cutting edge of the nail clipper device comprises slanted cutting surfaces and complementary cutting adjacent and juxtaposed surfaces that are moved side-by-side and adjacent to each other and in juxtaposed position with each other when the cutting configuration is brought into cutting relationship, the cutting edges defining a space therebetween when in an open non-cutting configuration, the space defining a separation distance therebetween, the separation distance comprising a first separation distance at one side of the cutting edges and a second separation at the opposite side of the cutting edges, wherein the first separation distance is greater than the second separation distance, and the cutting configuration provides a scissors-like cutting action that permits a cut nail to be retained close to the nail clipper device.

2. A nail clipper device according to claim 1, wherein the first separation distance that is greater than the second separation distance reduces linearly across the cutting edges.

3. A nail clipper device according to claim 1, wherein the first separation distance that is greater than the second separation distance reduces in an arcuate curved fashion across the cutting edges.

* * * * *